US006725781B2

(12) United States Patent
Niemeyer et al.

(10) Patent No.: US 6,725,781 B2
(45) Date of Patent: Apr. 27, 2004

(54) CARTRIDGE

(75) Inventors: Torsten Niemeyer, Celle (DE); Thomas Heitmann, Unterlüss (DE); Rupert Reinstadler, Hermannsburg (DE); Michael Vagedes, Hermannsburg (DE); Frank Schötzig, Celle (DE); Rainer Himmert, Lauf (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 10/394,581

(22) Filed: Mar. 24, 2003

(65) Prior Publication Data

US 2004/0003746 A1 Jan. 8, 2004

(30) Foreign Application Priority Data

Mar. 23, 2002 (DE) ..... 102 13 098
Oct. 18, 2002 (DE) ..... 102 48 697

(51) Int. Cl.[7] ..... F42B 5/08
(52) U.S. Cl. ..... 102/472; 102/430; 89/6.5
(58) Field of Search ..... 102/439, 472, 102/430, 469, 470; 89/6, 6.5

(56) References Cited

U.S. PATENT DOCUMENTS 4,033,266 A * 7/1977 Ziemba ..... 102/216
4,852,457 A * 8/1989 Schlegel et al. ..... 89/6.5
4,887,534 A * 12/1989 Dickovich et al. ..... 102/373
5,097,765 A * 3/1992 Ziemba ..... 102/218
5,485,788 A * 1/1996 Corney ..... 102/472
6,526,892 B2 * 3/2003 Heitmann et al. ..... 102/472

* cited by examiner

*Primary Examiner*—Charles T. Jordan
*Assistant Examiner*—T. Nguyen
(74) *Attorney, Agent, or Firm*—Venable LLP; Stuart I. Smith

(57) ABSTRACT

A cartridge, comprising a cartridge case (3), a projectile (4), a propellant charge igniter (8) extending in the direction of the longitudinal axis of cartridge (1) and arranged inside the cartridge case (3), and an electrically programmable projectile fuse arranged in the projectile (4) and connected via at least one electrical line (110) to an electrode on the cartridge base (2). The cartridge case (3) comprises at least two case sections (5, 6) with at least one separation location in the region between the front end (7) of the propellant charge igniter (8) and the projectile tail (9) for the installation of a section of the electrical line (110) between the cartridge base (2) and the projectile fuse using two rotating connector assemblies, one of which turns more easily than the other. One of the rotating connector assemblies is positioned on the propellant charge igniter and provided with a connection to the electrical line section that is oriented at an angle to the axis of rotation of the rotating connector assembly.

11 Claims, 2 Drawing Sheets

CARTRIDGE

CROSS REFERENCE TO RELATED APPLICATIONS

This application claims the priority of German Patent Applications DE 102 13 098.1, filed Mar. 23, 2002, and DE 102 48 697. 2, filed Oct. 18, 2002, which are incorporated herein by reference.

BACKGROUND OF THE INVENTION

The invention relates to a cartridge, comprising a cartridge case and a projectile, wherein the cartridge case contains a propellant charge igniter that extends in the direction of the longitudinal axis of the cartridge and wherein an electrically programmable projectile fuse is arranged inside the projectile. The projectile fuse is connected via at least one electrical line to an electrode on the cartridge base.

In the field of military technology, particularly relating to large-caliber ammunition, explosive ammunition with a programmable timed fuse is expected to have its maximum effectiveness in front of and above the target. The timed fuse must therefore be supplied with the respective data. If the data supply is intended to increase the flexibility of the tank crew in the loaded state, e.g. for switching between the various operating modes of the fuse and/or for effecting a subsequent change in the time signal even after the loading operation, the ammunition must have an electrical connection between the cartridge base and the fuse. The ammunition is then contacted via the tank system and the respective electronic guide systems.

In the case of a galvanic connection between the cartridge base and the projectile fuse, the loading operation and the installation of electrical lines must meet high requirements. In particular, with ammunition having a cartridge base that can be turned relative to the projectile head (as is the case for the Leopard 2 ammunition), it must be ensured that the electrical connecting lines cannot tear as a result of turning or that the naturally existing point of intersection of the lines is not interrupted.

Among other things, the electrical line provided inside the ammunition must meet the following requirements:

- low costs/low expenditure;
- installation so as to permit the loading operation;
- trouble-free data and energy transfer;
- ability of the electrical line to rotate;
- prevention of axial or radial forces from being exerted upon the propellant charge igniter;
- elastic absorption of axial or radial displacements;
- EMC stability;
- avoidance of long cable remnants on the propellant charge igniter following the firing, thus guaranteeing sufficient protection for the crew;
- avoidance of long cable remnants on the guide assembly following the separation, thus avoiding external ballistic interference;
- protection of the electrical line against powder dust; and
- avoidance of cable remnants inside the weapon barrel.

German Patent reference DE 100 52 741 A1 discloses a cartridge of the aforementioned type, for which the electrical connection in the region between the front end of the propellant charge igniter and the projectile tail section involves a rigid connector assembly, thus forming two conductor sections. The first conductor section that is connected to the cartridge base and extends along the propellant-charge igniter in the front-end region of the propellant charge igniter has a spiral design to improve the safety against rotation of the electrical line.

The disadvantages of the known cartridge include, among other things, an involved protection for the spirally wound cable (large space required), as well as a rigid connector assembly that does not permit a theoretically "infinite" turning of the two conductor sections relative to each other. In addition, the electrical line is very long, thus resulting in final ballistic interference of the projectile and endangerment of the tank personnel during the cartridge ejection after the ammunition is fired. Finally, it requires a time-consuming installation of the electrical line through the opening in the cartridge case on the side facing the projectile.

A cartridge of the aforementioned type with a programmable projectile fuse is furthermore known from reference DE 101 02 624 A1. This cartridge is provided on the front of the propellant charge igniter with a contact element in the form of a connector that is connected via a first conductor section extending through the propellant charge igniter to the electrode on the cartridge base. On the propellant charge igniter side facing the contact element, the projectile is provided with a bonnet or cowl-shaped receptacle that encloses the contact element and contains at least one bushing or sleeve-type contact, which has an electrically conducting connection to the projectile fuse via a second conductor section extending inside the projectile. To join the two conductor sections, the bushing-type contact element is fitted during the projectile assembly onto the plug-type contact element associated with the propellant charge igniter.

The fact that the production of the plug-in contacts and the bushing-type contacts is relatively involved is a further disadvantage of the cartridge. In addition, a bonnet that supports itself on the projectile tail section is required for accommodating the bushing-type contact. Finally, the connector assembly can be subject to extreme stresses during the projectile assembly, causing the plug-in contact to break off or the bonnet to be bent.

SUMMARY OF THE INVENTION

It is the object of the present invention to provide a cartridge of the aforementioned type wherein the electrical line to be inserted between the cartridge base and the projectile fuse can be installed easily and does not tear, not even following numerous projectile rotations relative to the cartridge base.

This object generally is achieved by the invention, according to which a cartridge comprises a cartridge case including a cartridge base, a projectile, a propellant charge igniter extending in the direction of the longitudinal axis of the cartridge and arranged inside the cartridge case, an electrically programmable projectile fuse arranged in the projectile, and at least one electrical line connecting the projectile fuse to an electrode arranged on the cartridge base, and wherein

- the cartridge case includes at least first and second case sections that are arranged axially one behind the other and are joined, with the first case section being connected to the cartridge base and extending to a front end of the propellant charge igniter, and the second case section being connected to the projectile, the projectile having a tail portion that extends to near an end of the second case section that faces the first case section;

the electrical line has a first rotating connector assembly in a region between a front end of the propellant charge igniter and the projectile tail portion, so that a first conductor section of the electrical line, which is arranged inside or on the outside of the propellant charge igniter, can be turned relative to a second conductor section that is arranged on the projectile; and a spring element arranged on the projectile tail portion, which acts upon the second conductor section and biases the second conductor section with a predetermined force toward the projectile tail portion.

Additional and particularly advantageous embodiments of the invention are disclosed and discussed.

According to the invention, the cartridge case consists of at least two parts, with at least one separation location in the region between the front end of the propellant charge igniter and the projectile tail. During the installation of the electrical lines, suspended sections of the cartridge case are joined in such a way that short ends of two conductor sections can be connected just prior to the final assembly using a gap between the suspended case sections and an inherently rotatable connector. The rotatable connector is attached to the propellant charge igniter and has a connection to one of the conductor sections that is oriented at an angle to the axis of rotation of the rotatable connector. This orientation provides a better transfer of the rotational movement and takes up the smallest possible space. The space between case sections required for ammunition loading is accommodated by attaching at least one suitable spring element, e.g. a spirally wound spring plate, to one of the conductor sections. At the same time, it is ensured that the conductor sections connected to the case sections respectively have short lengths. Following the loading operation, the spring element retracts the electrical line to a protected and locally fixed position. The required structural space is kept small enough that the connector assembly is protected against erosion and powder dust with a suitable bonnet-type element (protective element) of elastic material.

The above-mentioned requirements for the electrical signal line can be met with the aid of the invention.

Further details and advantages of the invention follow from the exemplary embodiments explained below with the aid of drawing figures.

DETAILED DESCRIPTION OF THE INVENTION

Figure 1:
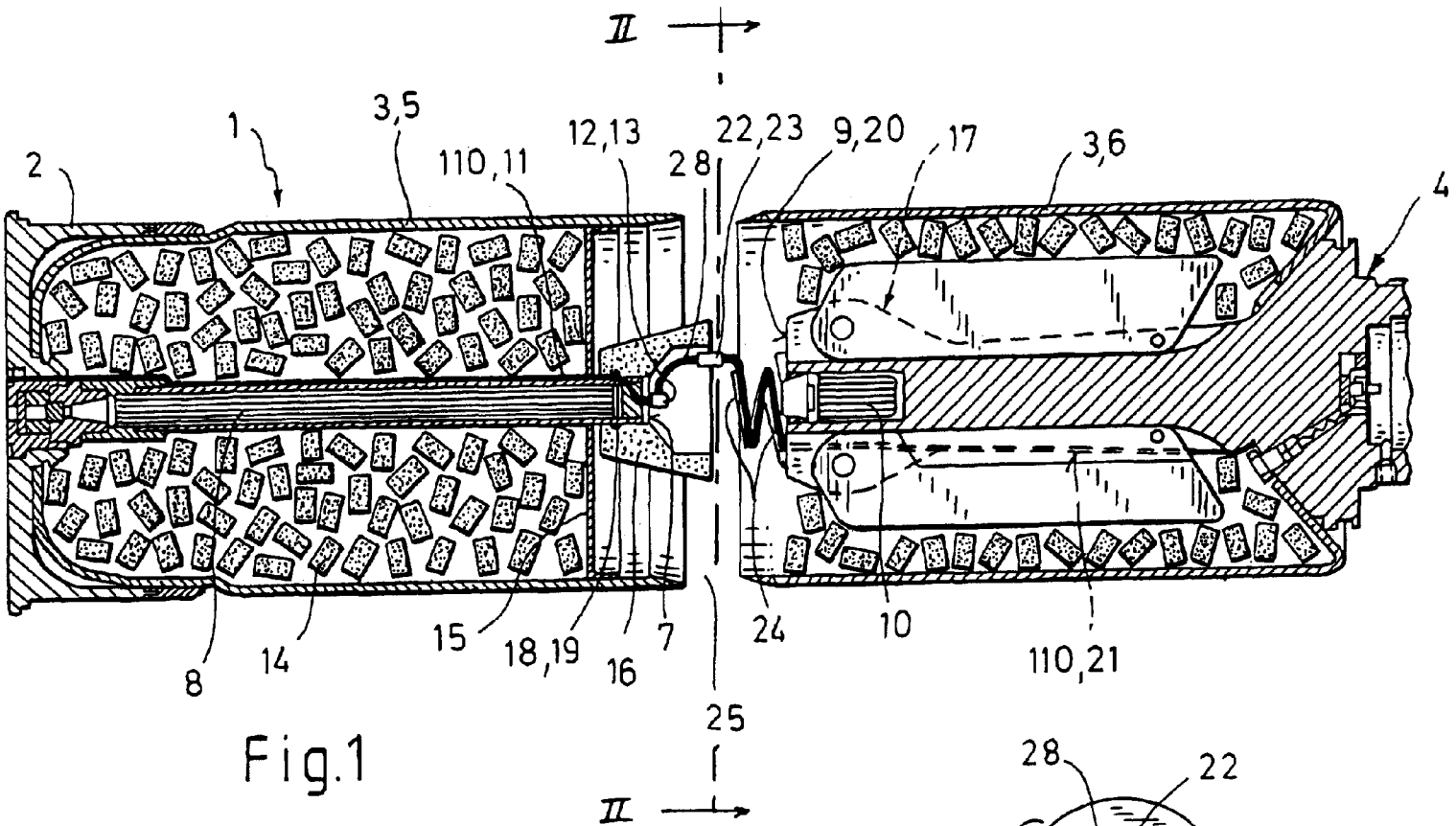
FIG. 1 is a longitudinal section through a cartridge according to the invention, without showing the front portion of the projectile of the cartridge, prior to joining the two sections of the propellant charge case.

In FIG. 1, the cartridge is given the reference 1 and comprises a cartridge base 2, a cartridge case 3 and a fin-stabilized projectile 4 with a programmable fuse. The nose-portion of the projectile, which projects from the cartridge case 3, is not shown herein.

The cartridge case 3 consists of two case sections 5, 6 that are arranged one behind the other in the axial direction and can be joined. The first case section 5 is here connected to the cartridge base 2 and extends up to the front end 7 of a propellant charge igniter 8 that is connected to the cartridge base 2 and extends along the axis of the cartridge base 2 and case section 5.

The second case section 6 is connected to the projectile 4. A tail region, or portion, 9 of the projectile 4 extends to near the second case section 6 end that is facing the first case section 5. A tracer set 10 is located in the center of the tail region 9 of the projectile.

A first conductor section 11 of a coaxial electrical line 110 is installed inside or on the outside of the propellant charge igniter 8 inside the first case section 5. The first conductor section 11 can be installed outside of the propellant charge igniter 8, below or above in a possibly existing heat-shrinking tube. At the tip of the propellant charge igniter 8, the conductor section 11 preferably ends in a centered position, if possible (as shown). The end of the first conductor section 11 is provided with a bushing-type element 12 of a first rotating connector assembly 13 of a commercially available type that includes an element that rotates easily relative to the bushing-type element 13 and preferably has a connection to another conductor section oriented at an angle, such as a right angle, to the axis of rotation of the first rotating connector assembly.

The powder grains 14 of the propellant charge powder in the first case section 5 must be covered with a cover 15, preferably made of silk gauze, for loading the ammunition into the cartridge 1, e.g., when connecting the two case sections 5 and 6.

A bonnet or cowl-type receptacle (protective sleeve) 16 is attached to the front end 7 of the propellant charge igniter 8 to protect the electrical line 110 against erosive powder grains and graphite dust, which is undesirable from an electrical point of view. The protective sleeve 16 is preferably made of an elastic material such as rubber or foam. As a result, the axial and radial movements of the guide assembly 17 of the fin-stabilized projectile 4 relative to the propellant charge igniter 8 (e.g., caused by environmental stresses such as vibration and fall) are absorbed without losing the sealing function. A combustible material can conceivably be used as well. However, this type of material has little elasticity and can compensate the relative movements inside the cartridge case 3 only with great difficulty.

Figure 3:
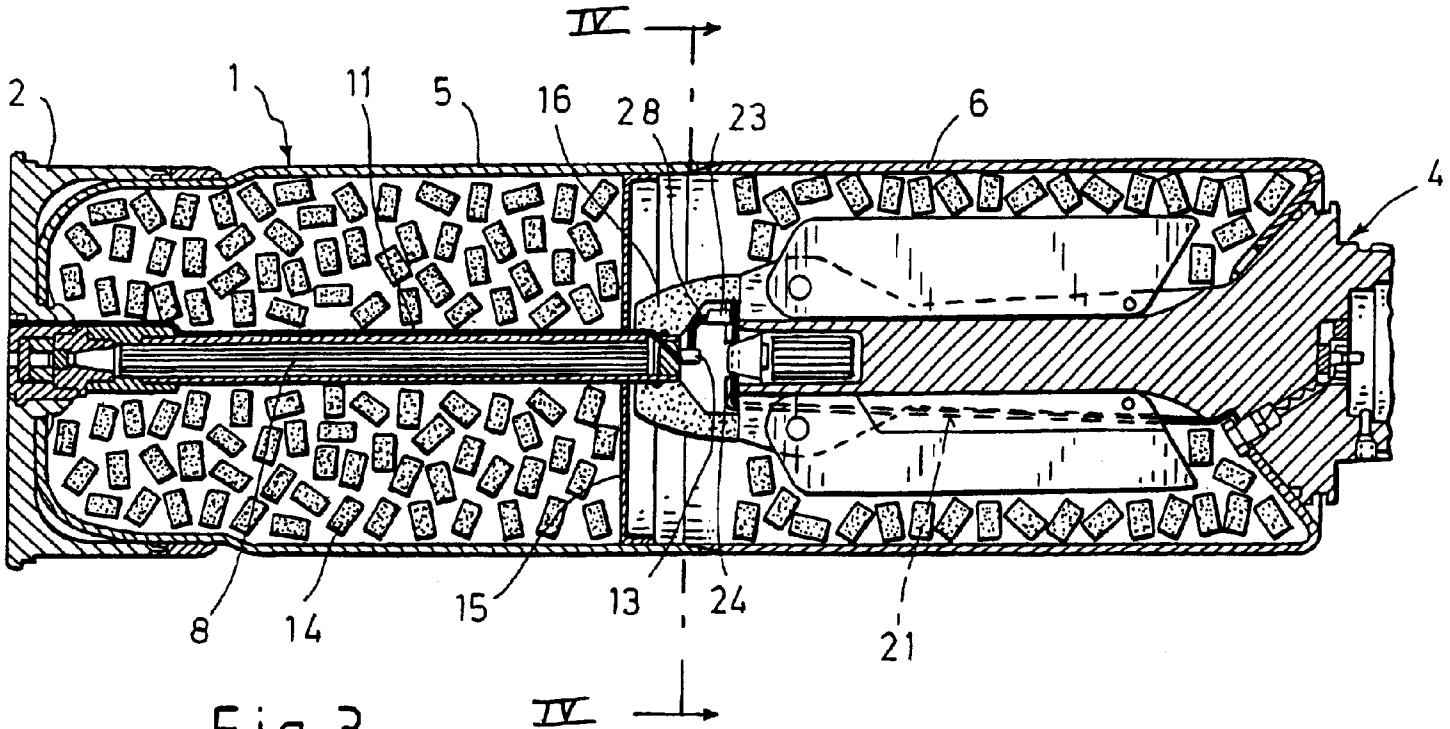
FIG. 3 is a longitudinal section according to FIG. 1 of the cartridge according to the invention, following the joining of the two case sections of the propellant charge case.

The protective sleeve 16 can be attached to the propellant charge igniter 8, for example, by gluing it on or, as indicated in FIGS. 1 and 3, by creating a form-fitting connection. The form-fitting connection in this case is realized with a circumferential bulge 18 as a slip barrier on the surface of the igniter 8. The protective sleeve 16 is then provided with a matching circumferential groove 19 along the inside diameter. A combination of fastening methods (form-fitting and gluing) can also be used.

The protective sleeve 16 is designed such that the electrical line 110 and the additional components in the sleeve region are completely enclosed following the loading operation. The axial length of the protective sleeve 16 is furthermore dimensioned such that it is subjected to axial pressure following the loading operation to compensate for tolerances in longitudinal direction, which exist of necessity in the cartridge 1, and to ensure an excellent and relatively tight fit against the guide assembly end 20.

A second conductor section 21 of the electrical line 110 extends from the direction of the fuse, not shown herein, inside the second case section 6, either inside or along the outside of the guide assembly 17. This second conductor section is also connected to a bushing-type element 22 of a second rotating connector assembly 23 having another element that is more resistant to turning relative to the bushing-type element 22 than is the other element of the first rotating connector assembly 13. The other element of the second rotating connector assembly 23 is connected to the second conductor section 21. The second conductor section 21 is pushed with a spring plate 24 against the guide assembly 17 to ensure a defined position of the second connector assembly 23, following the ammunition loading, as well as to prevent external ballistic interference caused by excessively long cable remnants. The spring plate 24 is attached on one side such that the second conductor section 21 can be lifted in the direction of the propellant charge igniter 8, owing to its elasticity. A liberal handling of a loading gap 25 for inserting tools is therefore possible.

The spring plate 24 has a circular shape since the projectile 4 is provided with a tracer set 10, thus keeping the exit opening 26 for the tracer set 10 clear. The connector assembly should preferably be arranged axially in this eccentric position.

Figure 2:
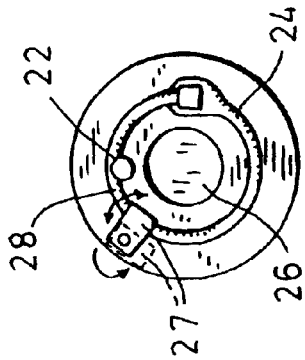
FIG. 2 is a view of the tail section of the projectile, as seen from the direction with reference II—II in FIG. 1.
Figure 4:
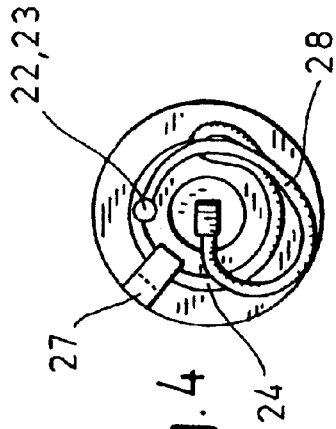
FIG. 4 is a view of the tail section of the projectile, as seen from the direction shown in FIG. 3 with IV—IV.

The size of the selected loading gap 25 depends on the number of windings of the spring plate 24. To prevent fluttering movements of the spring plate 24 along the trajectory and to aid the separation of the second connector assembly 23 during the projectile 4 acceleration, it has proven advantageous if a sheet-metal nose 27 is provided on the projectile tail, so that the spring plate 24 can be inserted with lateral pressure into the sheet-metal nose 27 just prior to the final assembly and remains there due to its internal stress (compare also FIGS. 2 and 4).

The first case section 5 is suspended by its base 2 for the ammunition loading operation. The cover 15 prevents the previously loaded propellant powder from escaping. All necessary components for the propellant charge igniter 8 are pre-installed before the loading operation.

The first case section 5 is lowered far enough toward the upright standing second case section 6 that is aligned with the first case section 5, so that a sufficiently large loading gap 25 remains. In this position, the second case section 6 is already filled with powder and the second conductor section 21 is already connected to the spring plate 24.

In the above-described position, the two bushing-type elements 12 and 22 of the rotating connector assemblies 13 and 23 are connected to each other via a relatively rigid third conductor section 28 by inserting the connectors on both ends of this conductor section 28, into the bushing-type elements 12, 22. Subsequently, the complete electrical line 110 is tested electrically. The conductor section 28 is detachable from at least the bushing-type element 22.

The final loading step involves joining the first and the second case sections 5, 6, for example, by gluing them together. During the joining of the case sections 5, 6, the spring plate 24 guides the conductor sections 11, 21, 28 in such a way that they remain inside the structural space required for the protective sleeve 16. The protective sleeve 16 thus can fit itself without problems and under pressure against the guide assembly 17 or the projectile base (FIG. 3).

The loading of the cartridge 1 is thus essentially completed. The conductor sections 11 and 21 are connected, the spring plate 24 is in the idle position and holds the second connector assembly 23 in its position. If the guide assembly 17 (and thus also the projectile 4) and the cartridge base 2 rotate counter-clockwise with the propellant charge igniter 8, the electrical conductor sections 11 and 21 can rotate along without getting twisted.

If the projectile 4 (and/or the guide assembly) is displaced along a radial, axial or circular course, relative to the propellant charge igniter 8, no forces are exerted onto the elastic electrical line 110 (except for the subordinate forces of the protective sleeve 16) and no forces are exerted onto the propellant charge igniter 8.

Of course, the invention is not limited to the above-described exemplary embodiment. For example, a second rotating connector assembly can be omitted. Furthermore, the spring plate can be omitted completely if the distance between the propellant charge igniter and the guide assembly can be kept small as a result of skillful loading, e.g. a "slanted" insertion of the propellant charge cases. In that case, the connector assembly (on the guide assembly side) would be arranged in the guide assembly itself.

The invention now being fully described, it will be apparent to one of ordinary skill in the art that many changes and modifications can be made thereto without departing from the spirit or scope of the invention as set forth herein.

What is claimed is:

1. A cartridge, comprising a cartridge case including a cartridge base, a projectile, a propellant charge igniter extending in the direction of the longitudinal axis of the cartridge and arranged inside the cartridge case, an electrically programmable projectile fuse arranged in the projectile, and at least one electrical line connecting the projectile fuse to an electrode arranged on the cartridge base; and wherein the cartridge case includes at least first and second case sections that are arranged axially one behind the other and are joined, with the first case section being connected to the cartridge base and extending to a front end of the propellant charge igniter, and the second case section being connected to the projectile, the projectile having a tail portion that extends to near an end of the second case section that faces the first case section;

the electrical line has a first rotating connector assembly in a region between a front end of the propellant charge igniter and the projectile tail portion, so that a first conductor section of the electrical line, which is arranged inside or on the outside of the propellant charge igniter, can be turned relative to a second conductor section that is arranged on the projectile; and a spring element arranged on the projectile tail portion, which acts upon the second conductor section and biases the second conductor section with a predetermined force toward the projectile tail portion.

2. The cartridge according to claim 1, wherein the first rotating connector assembly is arranged on the front end of the propellant charge igniter, a second rotating connector assembly is connected to the second conductor section and arranged on the spring element, and a third, rigid conductor section is connected between the first and second rotating connector assemblies.

3. The cartridge according to claim 2, wherein the first connector assembly is formed to turn more easily than the second connector assembly (23).

4. The cartridge according to claim 1, wherein the spring element is a spring plate.

5. The cartridge according to claim 4, wherein the projectile has a tracer set with an exit opening for combustion, and the spring plate has a circular or circular-segment design, such that the exit opening for combustion gases is not blocked.

6. The cartridge according to claim 5, wherein the first rotating connector assembly is arranged on the front end of the propellant charge igniter, a second rotating connector assembly is connected to the second conductor section and arranged on the spring element, a third, rigid conductor section is connected between the first and second rotating connector assemblies, and the second rotating connector assembly is arranged to the side of the tracer set in the projectile.

7. The cartridge according claim 1, wherein a bonnet-type receptacle is provided on the front end of the propellant charge igniter, the bonnet-type receptacle contacting the projectile tail portion and enclosing the electrical line between the propellant charge igniter and the projectile tail portion, including the rotating connector assembly.

8. The cartridge according to claim 7, wherein the bonnet-type receptacle is formed of an elastic material.

9. The cartridge according to claim 8, wherein the length of the bonnet-type receptacle is such that the bonnet-type receptacle contacts the tail portion under axial pressure when the first and second case sections are joined.

10. The cartridge according to claim 1, wherein the first rotating connector assembly has a connection to a conductor section, the connection being oriented at an angle to the axis of rotation of the first rotating connector assembly.

11. The cartridge according to claim 2, wherein the first rotating connector assembly has a connection to the third, rigid conductor section, the connection being oriented at an angle to the axis of rotation of the first rotating connector assembly.

* * * * *